US011484998B2

(12) United States Patent
Hsu et al.

(10) Patent No.: US 11,484,998 B2
(45) Date of Patent: Nov. 1, 2022

(54) ELECTRIC TORQUE WRENCH CAPABLE OF SENSING MANUAL OPERATING TORQUE

(71) Applicant: TECHWAY INDUSTRIAL CO., LTD., Taichung (TW)

(72) Inventors: Chih-Hua Hsu, Taichung (TW); Wei-Ming Chen, Taichung (TW)

(73) Assignee: TECHWAY INDUSTRIAL CO., LTD., Taichung (TW)

( * ) Notice: Subject to any disclaimer, the term of this patent is extended or adjusted under 35 U.S.C. 154(b) by 245 days.

(21) Appl. No.: 17/081,708

(22) Filed: Oct. 27, 2020

(65) Prior Publication Data

US 2021/0122016 A1 Apr. 29, 2021

(30) Foreign Application Priority Data

Oct. 29, 2019 (TW) ..... 108139087

(51) Int. Cl.

| | |
|---|---|
| ***B25B 23/147*** | (2006.01) |
| ***B25B 13/06*** | (2006.01) |
| *B25B 23/142* | (2006.01) |
| *B25B 23/00* | (2006.01) |

(52) U.S. Cl.

CPC ..... *B25B 23/147* (2013.01); *B25B 13/06* (2013.01); *B25B 23/0014* (2013.01); *B25B 23/1425* (2013.01)

(58) Field of Classification Search

CPC ..... B25B 23/147; B25B 13/06; B25B 21/00; B25B 23/1427; B25B 23/1425; B25B 23/1422

USPC ..... 173/176

See application file for complete search history.

(56) References Cited

U.S. PATENT DOCUMENTS

2019/0275647 A1* 9/2019 Silha ..... B25B 21/004
2020/0164495 A1* 5/2020 Wang ..... G01L 3/108

* cited by examiner

*Primary Examiner* — Andrew M Tecco
*Assistant Examiner* — Jacob A Smith
(74) *Attorney, Agent, or Firm* — Guice Patents PLLC

(57) ABSTRACT

An electric torque wrench capable of sensing a manual operating torque includes: an outer housing having an accommodating space at an internal thereof, a motor and a reduction device arranged therein; the reduction device having a reduction gear assembly with a hollow ring gear member; a front end of the ring gear member having at least one extension arm and at least one sensing plane formed thereon; a torque sensing unit arranged on the sensing plane; a driving device installed at the front end of the outer housing and having a working head arranged at the front end thereof; the extension arm of the ring gear member secured and attached onto the driving device. With the torque sensing unit installed on the extension arm, the electric torque wrench can be rotated manually with hand and is able to measure the torque value.

20 Claims, 10 Drawing Sheets

ELECTRIC TORQUE WRENCH CAPABLE OF SENSING MANUAL OPERATING TORQUE

BACKGROUND OF THE INVENTION

1. Technical Field

The present invention relates to an electric tool, and in particular, to an electric torque wrench capable of sensing a manual operating torque by utilizing a reduction device installed with a torque sensing unit thereon such that it is able to detect a manual driving torque.

2. Description of Related Art

A known electric torque tool mainly utilizes a motor as a driving source, and a torque can be generated via motor driving in order to allow a workpiece, such as a screw, to generate axial rotation, thereby achieving the effect of fastening or unfastening the workpiece. During the fastening or unfastening of the workpiece performed by a known electric torque tool, since its torque is relatively small, motor is able to rotate at high speed continuously, such that the performance time can be reduced. However, during the moment when the workpiece is about to be fastened tightly, the rotation of such workpiece becomes more difficult, and the motor is required to generate greater torque to fasten the workpiece firmly. Accordingly, the motor needs to adopt the method of increasing the current in order to generate a greater torque supply. Nevertheless, during the fastening process, the driving force of the motor is subject to the effect of inertial force such that the torque value exerted tends to exceed the setting torque value, thereby causing a difference between the actual fastening torque value and the setting torque value.

Presently, to improve such drawback, it is known that there are relevant improvement products. For example, U.S. Patent Application No. 62/393,862, Taiwan Utility Model No. M556196, "Powered Ratcheting Torque Wrench" is a powered ratcheting torque wrench, and the following component reference numbers disclosed refer to the reference numbers used in the original application content. The powered ratcheting torque wrench is able to use an electric motor (18) as a driving source to generate a torque, and its output assembly (24) includes a transducer assembly (118) with a strain gauge (142) installed thereon. The strain gauge (142) can be used to detect the force exerted by the hand such that after the torque wrench is driven by the electric motor (18), the user's hand then exerts a force for rotation and to exert the torque. The manual operating torque value can be detected by the strain gauge (142) in order to display its value. Through the rotation performed by the hand, it is able to generate a relatively precise fastening torque value, thereby maintaining the fastening torque value of the workpiece to be within the range of the setting value.

Nevertheless, in the aforementioned prior art, the strain gauge (142) is attached onto the transducer assembly (118) of the output assembly (24), and to attach the strain gauge (142) onto the transducer assembly (118), it requires heating and baking processes in order to secure the strain gauge (142) onto the transducer assembly (118). If the baking process is performed after the entire set of the output assembly (24) is complete, then the internal components of the output assembly (24) did not process with any heat treatment, may generate deformation due to the temperature effect after heating. As a result, its precision is reduced or cannot function properly. On the other hand, if the baking process is performed on the transducer assembly (118) and the strain gauge (142) first and then assembled onto the output assembly (24), then the strain gauge (142) is likely to be damaged due to collision during the assembly process, leading to reduction of the assembly yield rate.

Furthermore, the transducer assembly (118) of the output assembly (24) also requires additional design and processing. However, the process required for securing the strain gauge (142) and the transducer assembly (118) is complicated and the manufacturing cost is increased relatively. Moreover, the transducer assembly (118) increases the overall length of the output assembly (24), and the crankshaft (46) of the powered ratcheting torque wrench penetrates through the entire output assembly (24); therefore, it has a relatively long length, causing the crankshaft (46) to bend under the condition of manual rotation by hand. If the crankshaft (46) is designed to be a shaft, it may generate deformation during the manual rotation by hand and may also absorb a portion of the force exerted, leading to insufficient detection value or errors in the strain gauge (142). To prevent deformation of the crankshaft (46), and to allow it generate the bending effect upon the exertion of force, the crankshaft (46) is formed by two shafts (157, 158), and a universal joint (162) is used for pivotal attachment between the two shafts (157, 158). The universal joint (162) is able to allow the crankshaft (46) to generate bending deformation. However, due to such configuration, the number of components of the crankshaft (46) is increased and the processing and assembly cost is also increased.

BRIEF SUMMARY OF THE INVENTION

An objective of the present invention is to provide an electric torque wrench capable of allowing manual and electric operations, and also capable of measuring a torque value exerted by a hand.

To achieve the aforementioned objectives, the present invention provides an electric torque wrench capable of sensing a manual operating torque, comprising:

an outer housing having an accommodating space at an internal thereof;

a motor and a reduction device arranged inside the accommodating space sequentially; the reduction device positioned at a front end of the motor and having a reduction gear assembly connected to the motor; the reduction gear assembly having a transmission shaft arranged thereon; the reduction gear assembly having a hollow ring gear member arranged thereon;

the ring gear member having a front end with at least one extension arm having at least one sensing plane formed thereon; the transmission shaft of the reduction gear assembly configured to extend outward from the ring gear member;

at least one torque sensing unit arranged on the sensing plane;

a driving device installed at a front end of the outer housing, a working head arranged at the front end and configured to be driven by the transmission shaft to generate a rotation with an axial direction of the working head as a center of rotation; the ring gear member secured and attached onto the driving device.

Preferably, the electric torque wrench includes an operating plane arranged perpendicular to the axial direction of the working head.

Preferably, the angle between the operating plane of the working head and the sensing plane of the ring gear member is 1 degree-90 degrees.

Preferably, the ring gear member includes an extension arm.

Preferably, the ring gear member includes two extension arms positioned at two sides of the front end of the ring gear member respectively.

Preferably, a free end of the extension arm includes a circular ring installed thereon and the circular ring is secured onto the driving device.

For the electric torque wrench capable of sensing a manual operating torque provided by the present invention, the ring gear member is connected to the driving device; therefore, the motor can be used as a power source to drive the working head to rotate, and the manual method can also be utilized to exert a torque. The deformation generated during the manual exertion of the torque is able to cause the generation of deformation on the driving device and the extension arm on the ring gear member connected to the driving device, such that the torque sensing unit installed on the extension arm can be used to measure the torque, thereby providing a precise manual operating torque value. Furthermore, since the ring gear member is a necessary component, in the present invention, it only needs to provide the extension arm on the ring gear member; therefore, the processing procedure does not require complicated additional procedures. In addition, the internal structure of the reduction gear assembly are mostly formed of component parts that have previously received the heat treatment; consequently, the baking and bonding process further performed on the torque sensing unit for adhesively attaching onto the extension arm would not have any impact on the precision of the component parts inside the reduction device, thereby increasing the production yield rate.

BRIEF DESCRIPTION OF THE SEVERAL VIEWS OF THE DRAWINGS

The objectives, technical features and the technical effects of the present invention can be understood through the preferred embodiments of the present invention. To be more specific, two preferred embodiments are described in the following along with the accompanied drawings in detail.

DETAILED DESCRIPTION OF THE INVENTION

Figure 1:
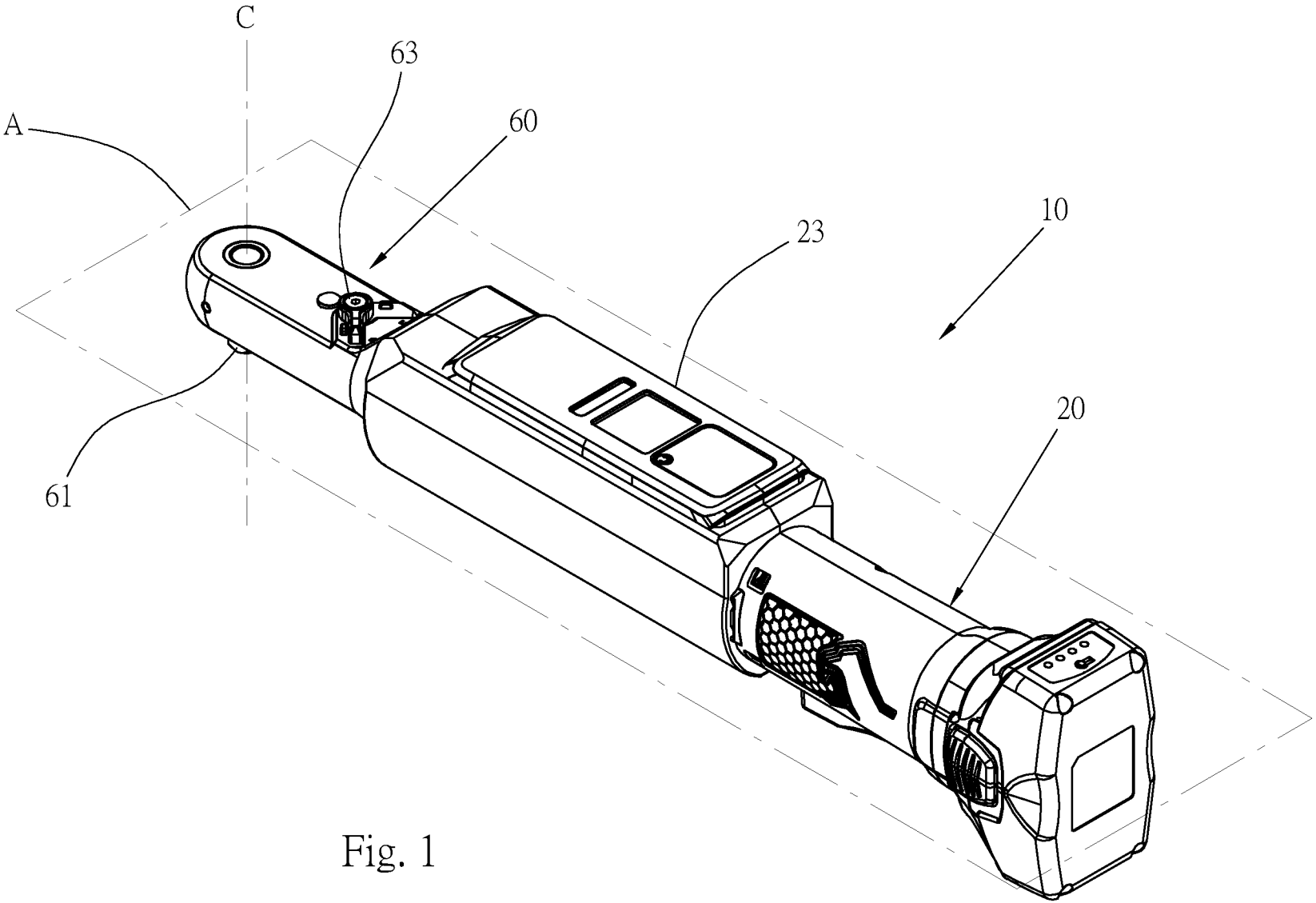
FIG. 1 is a perspective appearance view of the electric torque wrench according to a preferred embodiment of the present invention.
Figure 2:
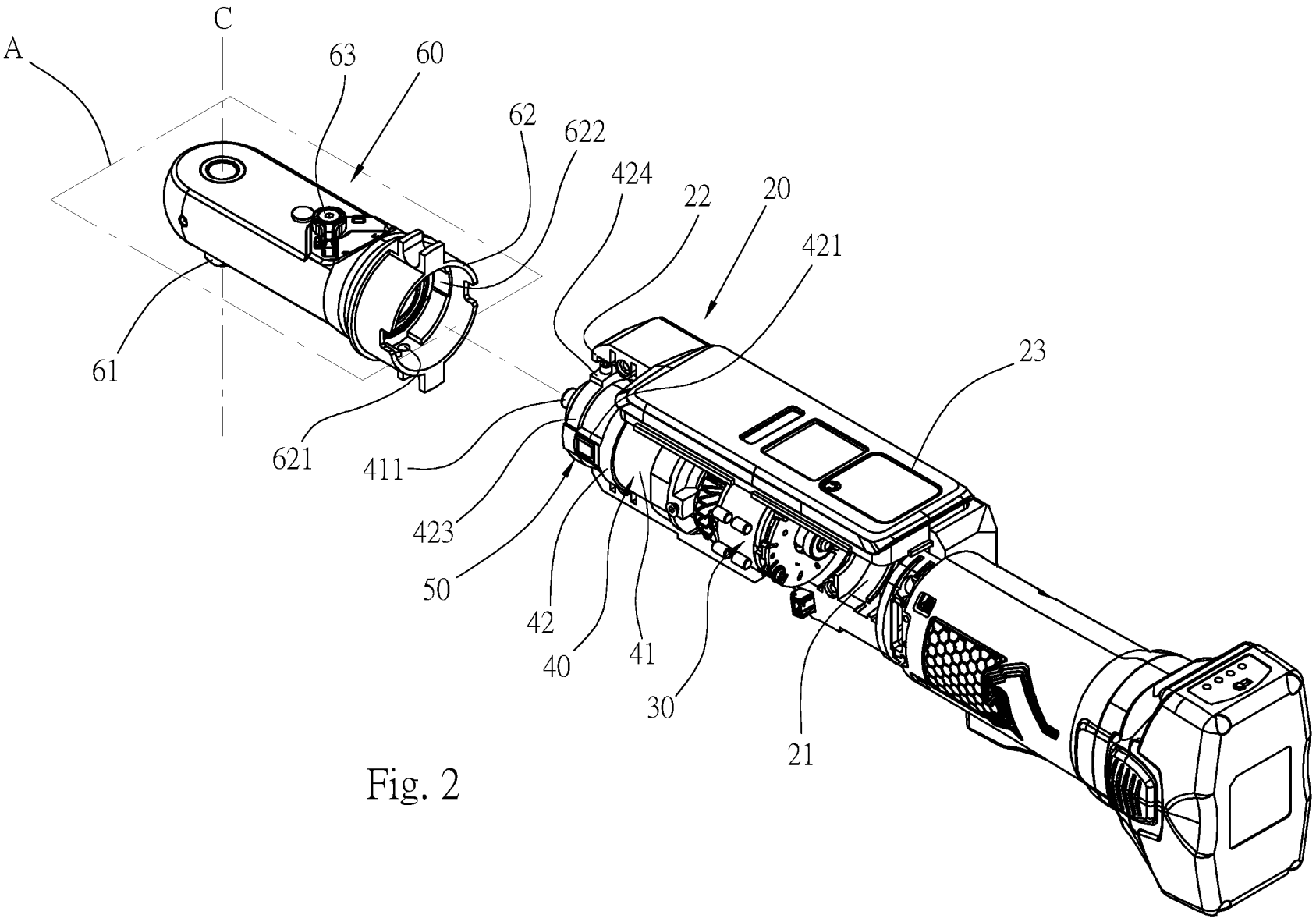
FIG. 2 is an exploded view of a partial cross section of FIG. 1.

Please refer to FIG. 1 to FIG. 2, showing an electric torque wrench 10 according to a preferred embodiment of the present invention, comprising:

An outer housing 20 includes an accommodating space 21 at an internal thereof and a front end with an opening 22 formed thereon. The external of the outer housing 20 includes a human-machine interface 23, and the human-machine interface 23 can be equipped with different configuration of a microprocessor, operating buttons and a display screen etc. depending upon the needs such that an interface connected to the electric torque wrench can be provided to the user. Since this part belongs to the structure of a known electric torque wrench, details thereof are omitted hereafter.

Figure 4:
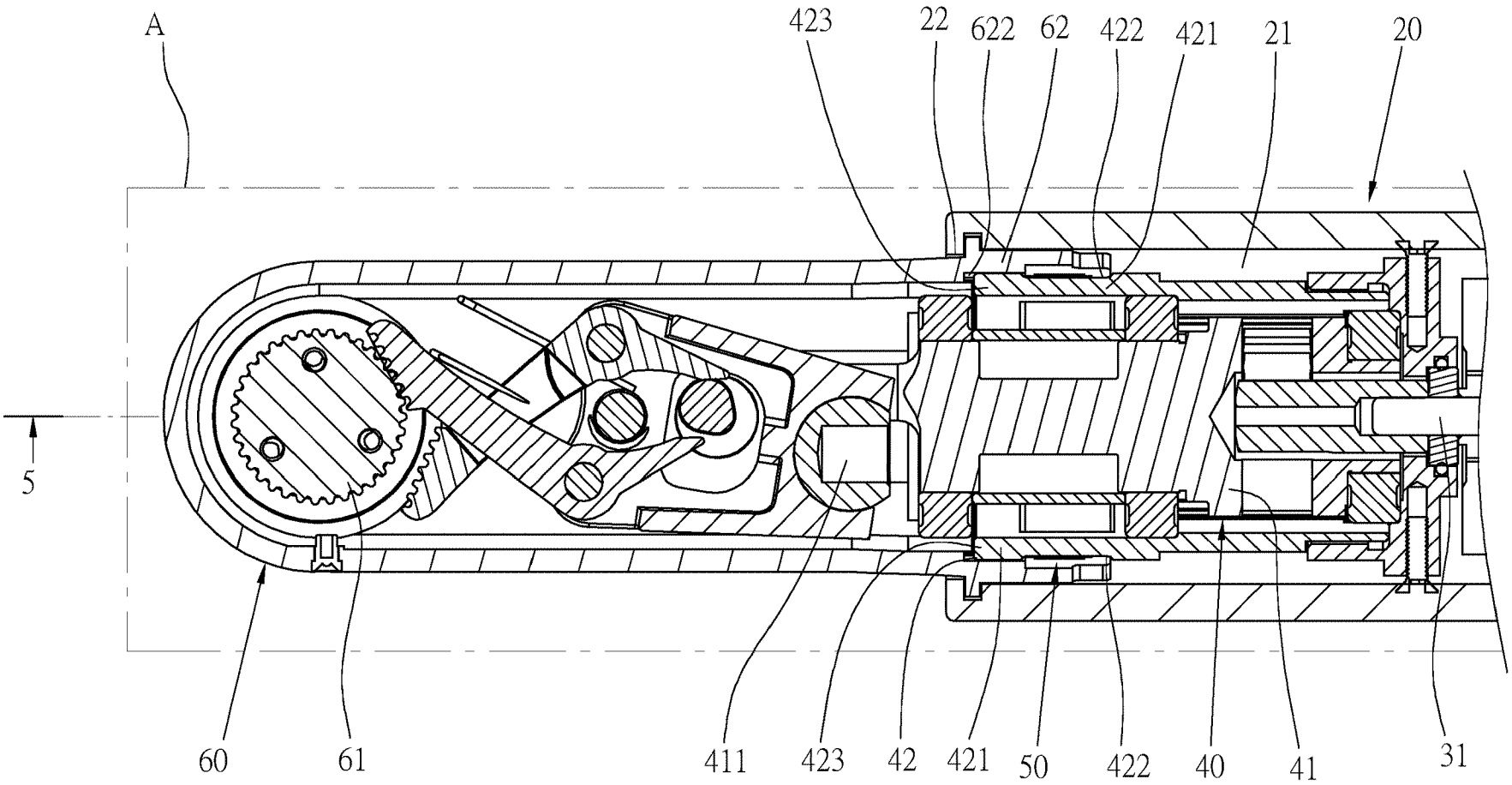
FIG. 4 is a cross sectional view in a vertical direction of the electric torque tool of FIG. 1.

A motor 30 includes a driving shaft 31, as shown in FIG. 4, facing toward the direction of the opening 22 of the outer housing 20. The motor 30 is arranged inside the accommodating space 21 of the outer housing 20, and it is configured to be driven by a power source, such as a battery in this embodiment, in order to generate the effect of driving the driving shaft 31 to rotate.

Figure 3:
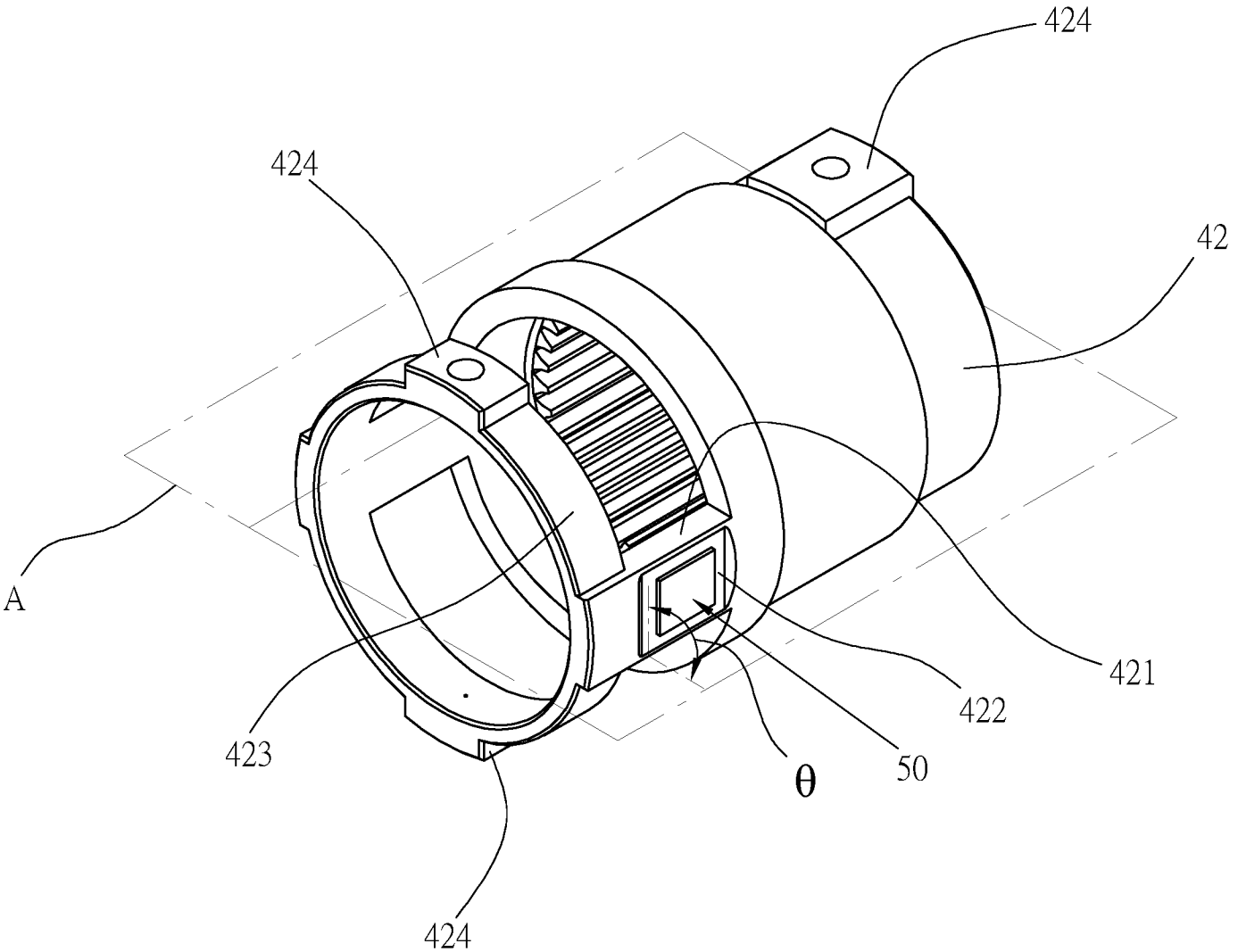
FIG. 3 is a perspective appearance view of the ring gear member according to a preferred embodiment of the present invention.
Figure 5:
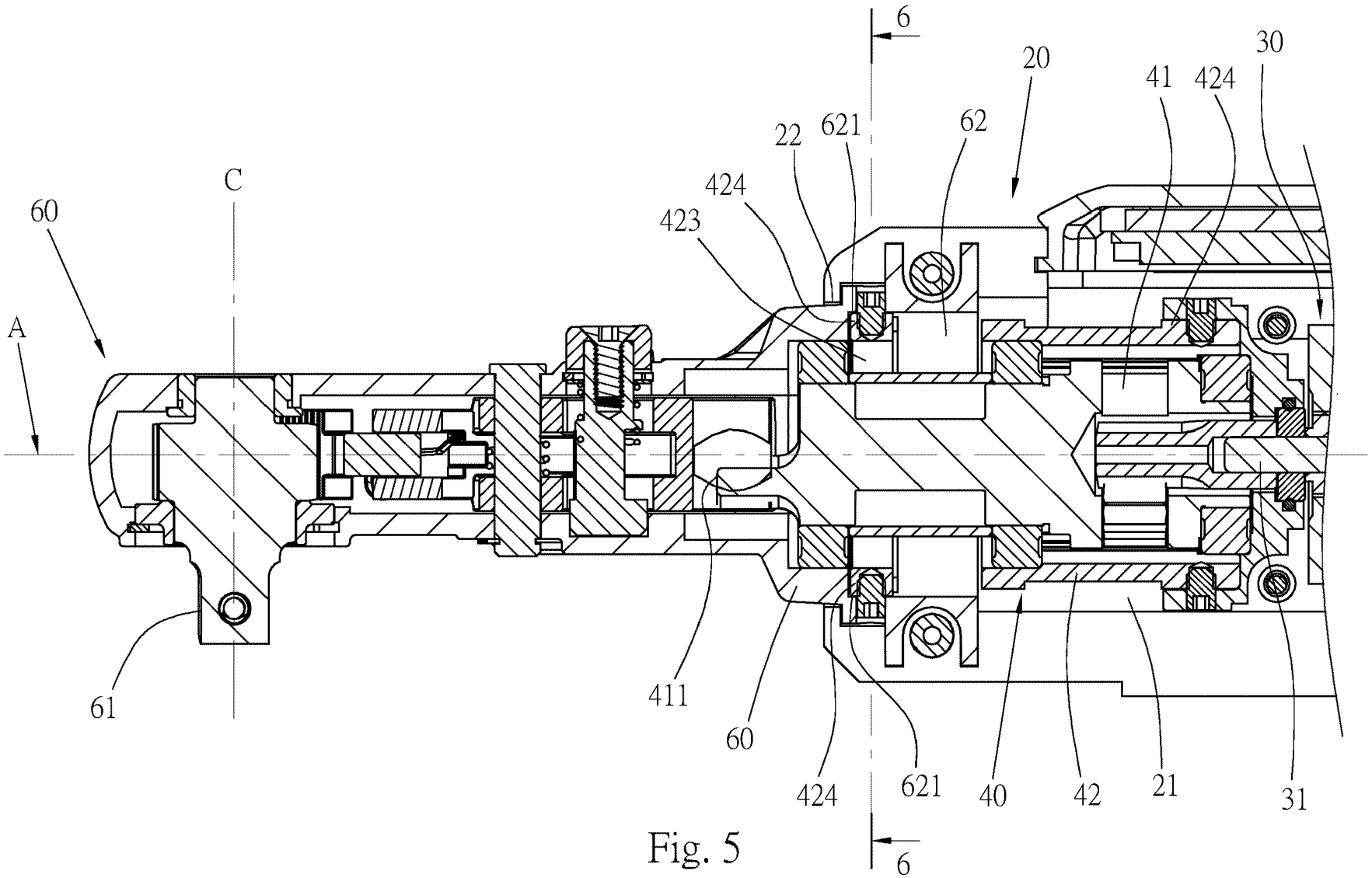
FIG. 5 is a cross sectional view in a horizontal direction of the electric torque tool of FIG. 1.

Please further refer to FIG. 4 and FIG. 5. A reduction device 40 is arranged inside the accommodating space 21 of the outer housing 20 and is positioned at the front end of the motor 30. The reduction device 40 includes a reduction gear assembly 41 connected to the driving shaft 31. The reduction gear assembly 41 can be a planetary gear assembly or other gear assembly using the change of gear ratio of gears to adjust the rotational speed, and its front also includes a transmission shaft 411 protruded outward therefrom. Please refer to FIG. 3, the outer side of the reduction gear assembly 41 includes a hollow ring gear member 42, and it is securely attached onto the outer housing 20. The transmission shaft 411 penetrates through the hollow portion of the ring gear member 42 and extend toward the opening 22. The inner circumferential surface of the ring gear member 42 includes inner engagement teeth capable of engaging with other gears of the reduction gear assembly 41. The front end of the ring gear member 42 includes two extension arms 421 and a sensing plane 422 is formed on the two extension arms 421 respectively. In this embodiment, the sensing plane 422 is arranged on the outside plane of the extension arm 421. The portion between the two extension arms 421 forms a hollow portion such that when the two extension arms 421 are subject to force exertion, they are able to generate a relatively greater deformation. The free ends of the two extension arms 421 include a circular ring 423. In addition, to allow the ring gear member 42 to be attached onto the outer housing 20, the rear side of the ring gear member 42 and the circular ring 423 include two fastening pieces 424 formed thereon respectively in order to allow a screw to penetrate through and to be fastened between the fastening pieces 424 at the rear side of the ring gear member 42 and the outer housing 20, thereby allowing the ring gear member 42 to be fastened onto the outer housing. In this embodiment, the fastening pieces 424 and the two extension arms 421 are arranged perpendicular to each other. However, it can be understood, that the angle between the two can be adjusted depending upon the assembly and design needs, such that the present invention is not limited to any angle thereof.

Two torque sensing unit 50 are respectively arranged on the two sensing planes 422. Each one of the torque sensing units 50 in this embodiment refers to a strain gauge, and it can also be other sensor capable of detecting the torque value via the amount of deformation, and the present invention is not limited to any type of sensing units. The torque sensing units 50 are also electrically connected to the human-machine interface 23 in order to transmit the signal obtained to the human-machine interface 23. The two torque sensing units 50 can be arranged to detect the deformations generated by the force exerted in different directions such that a deformation value can be obtained through computation and integration, or the force exerted in different directions can be detected respectively. In practice, it can be arranged only one single torque sensing unit 50 on the sensing plane 422 of one extension arm 421. After the torque sensing unit 50 is adhesively attached onto the sensing plane 422 of the extension arm 421, it is necessary to perform a baking procedure. The internal of the reduction device 40 mostly includes gear elements, and heat treatment is typically implemented on such elements. During the baking procedure, the temperature of the baking procedure is lower than the heat treatment temperature of the elements inside the reduction device 40; therefore, the baking and adhesive attachment operation would not affect the ring gear member 42 and other elements of the reduction device 40. Consequently, the yield rate and precision of the electric torque wrench assembly can be increased.

Figure 6:
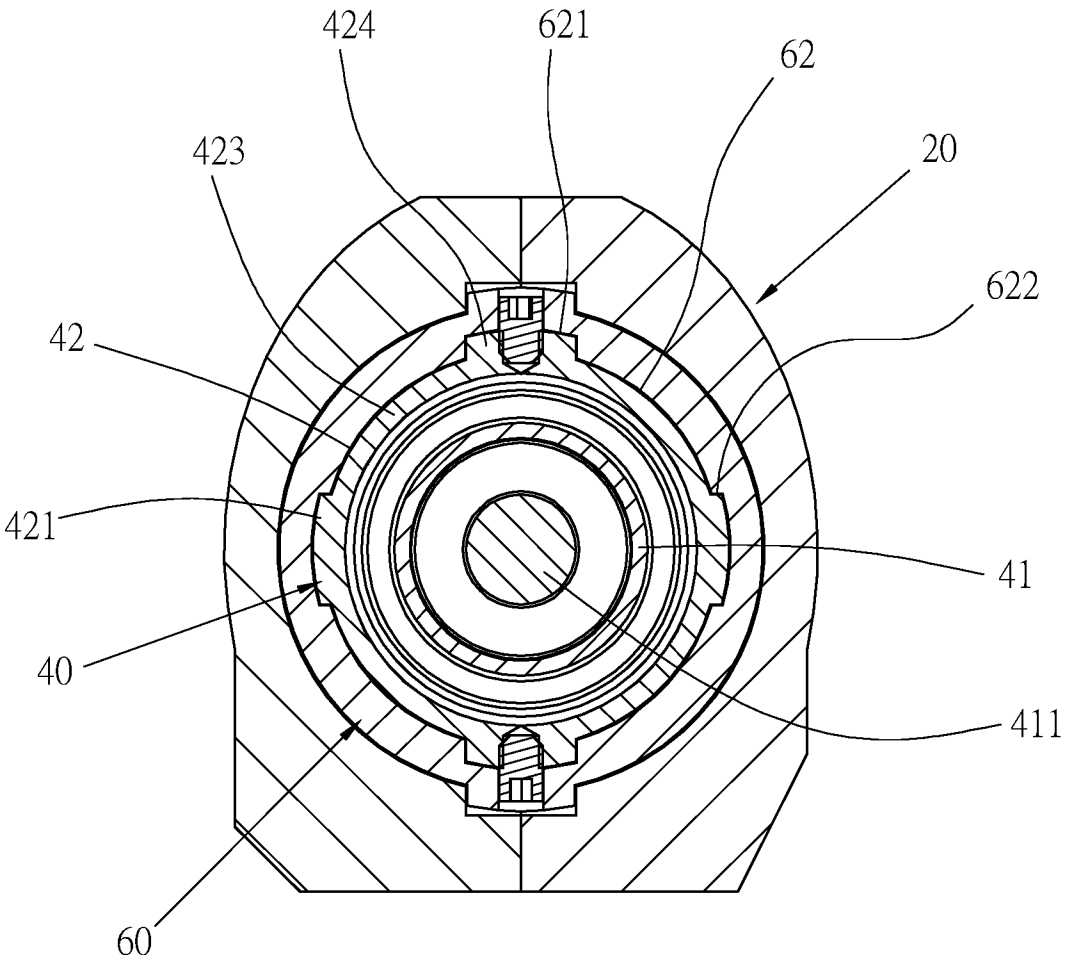
FIG. 6 is a partial cross sectional view showing the attachment location between the ring gear member and the driving device.

A driving device 60 is installed at the front end of the outer housing 20 and is configured to be driven by the transmission shaft 411 of the reduction device 40. The driving device 60 further includes a ratchet mechanism capable of being driven by the transmission shaft 411 in order to generate forward and reverse rotations. Since such ratchet mechanism is a known component part, details thereof are omitted hereafter. The front end of the driving device 60 includes a working head 61, and in accordance with the directions shown in FIG. 5, the working head 61 includes an operating portion facing downward and exposed to the external, which can have the structural shape of, such as a polygonal column or a groove, in order to drive a workpiece or a sleeve. The vertical direction of the working head 61 refers to the axial direction C, and it is longitudinally perpendicular to the torque wrench. The working head 61 is able to generate a rotation with the axial direction C as the center of rotation in order to drive the workpiece to rotate. An operating plane A is perpendicular to the axial direction, and the sensing planes 422 on the two extension arms 42 of the ring gear member 40 form an angle θ with the operating plane A, and the angle θ is between 1 degree~90 degrees. In this embodiment, the angle θ between the sensing plane 422 and the operating plane A is 90 degrees. The rear end of the driving device 60 is a mounting portion 62, and it is of a hollow shape. The mounting portion 62 also penetrates between the ring gear member 42 and the outer housing 20 in order to allow the driving device 60 to be secured inside the outer housing 20. Please refer to FIG. 6, the internal of the mounting portion 62 further includes two fastening slots 621 and two retaining slots 622. The two fastening pieces 424 on the circular ring 423 at the front end of the ring gear member 42 and the two extension arms 421 are installed inside the two fastening slots 621 and the two retaining slots 622 respectively in order to secure the installation location between the ring gear member 42 and the driving device 60, thereby preventing any changes in the position between the ring gear member 42 and the driving device 60. Please refer to FIG. 4, the outer side of the driving device 60 further includes a shifting rod 63, and by setting the shifting rod 63 at different directions, the working head 60 is able to rotate in a specific direction.

Figure 7:
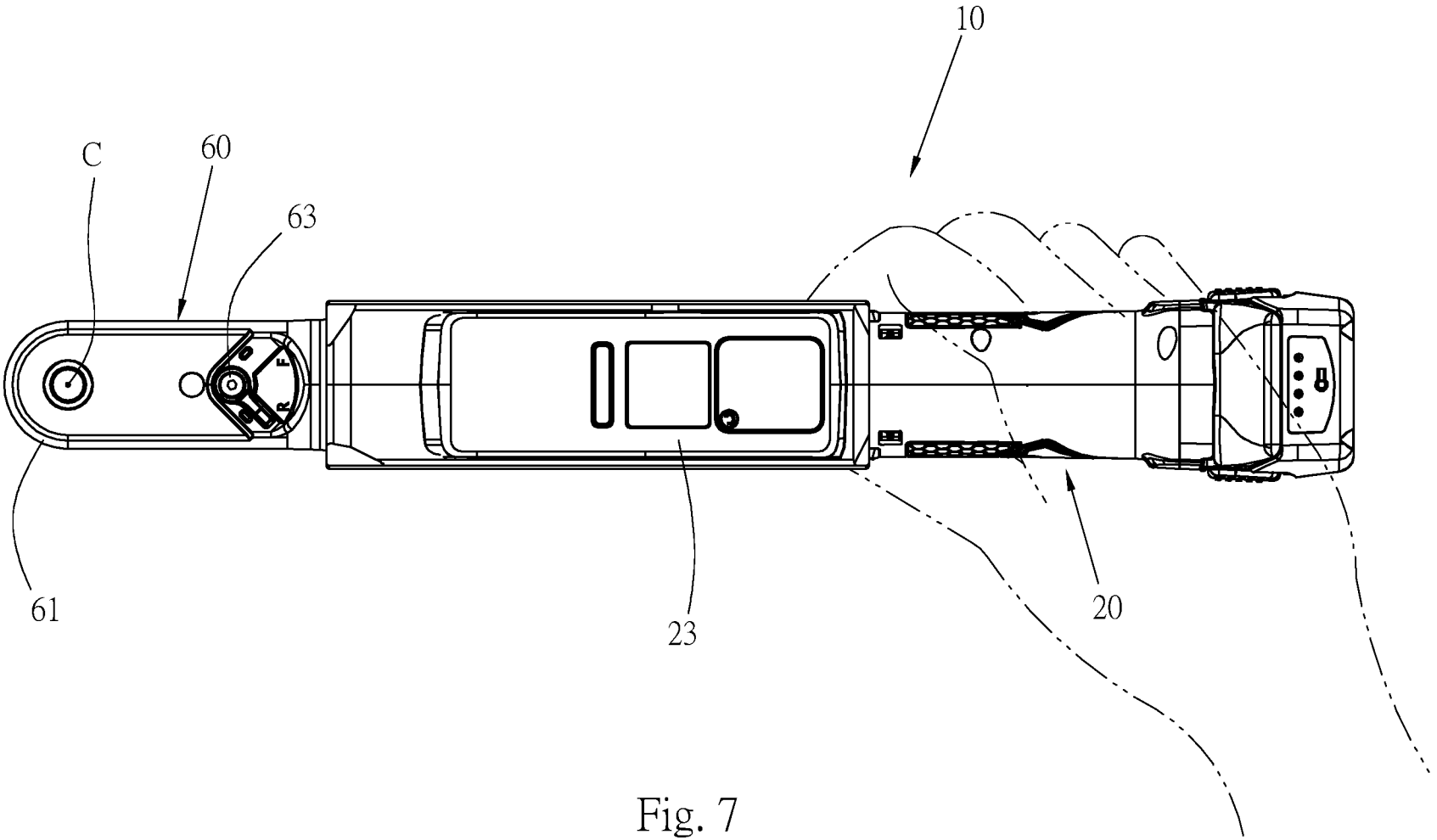
FIG. 7 is an illustration shown an action state of the electric torque tool with a force exerted by hand.
Figure 8:
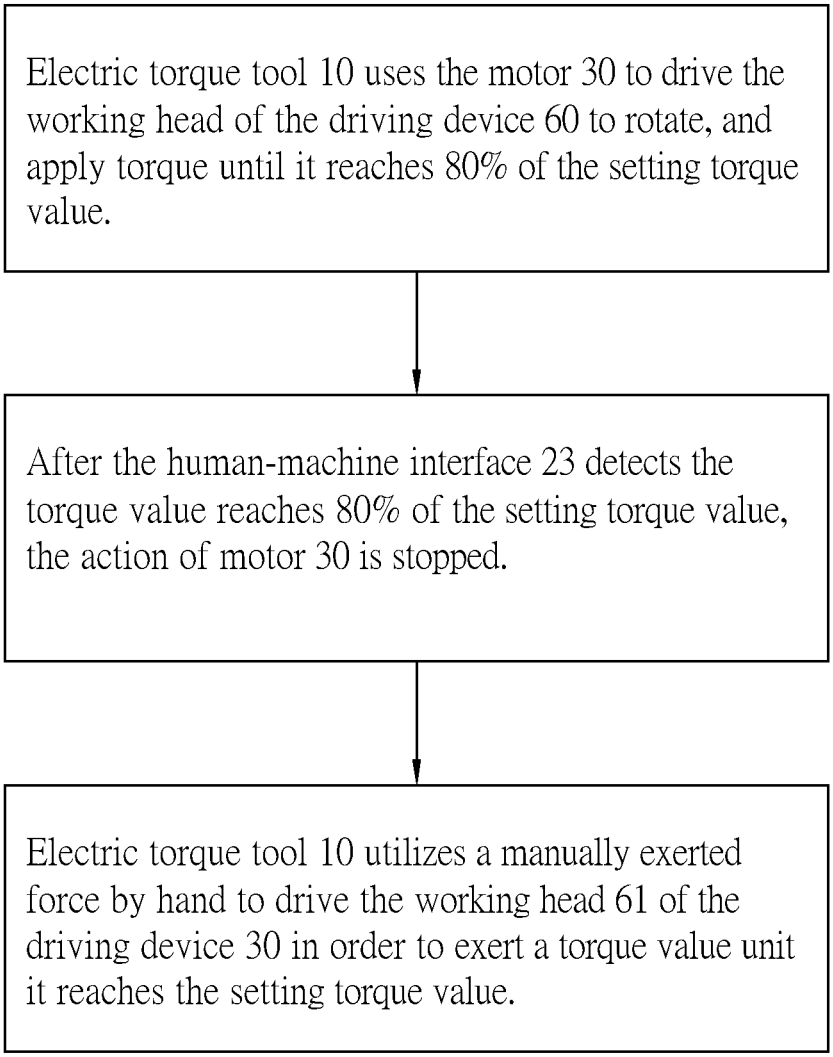
FIG. 8 is an operation flowchart of the electric torque tool of the present invention switching from electric operation to manual operation.

Please refer to FIG. 5, FIG. 7 and FIG. 8. During the operation of the electric torque wrench 10, it can be divided into two stages. The first stage is to use the motor 30 to drive the working head 61 of the driving device 60 in order to rotate a workpiece at a fast speed. When the workpiece is rotated to a fastened state, in this embodiment, such state is set to be the state when the torque value applied by the motor 30 reaches 80% of the setting torque value. Once such state is reached, the motor 30 stops driving, and the user then manually rotate the wrench by applying a force with the hand to the electric torque wrench 10, such that after the force is exerted onto the working head 61, it is able to provide a precise torque in order to perform fastening action. The percentage of the setting torque value that is reached to stop the motor 30 can be adjusted. As a result, it is able to prevent the situation where the torque applied by the motor 30 excessively exceeds the setting value due to error or inertia factor during the time when the motor is about to reach the setting torque value, ruining the fastening operation.

Please refer to FIG. 5, showing an illustration of the motor 30 of the present invention is used a driving means. During the action of fastening or unfastening at fast speed, the driving shaft 31 of the motor 30 is able to drive the reduction gear assembly 41 of the reduction device 40 to perform a speed reduction. After the speed is reduced, it is then transmitted via the transmission shaft 411 in order to allow the working head 61 of the driving device 60 to be able to rotate rapidly with the axial direction C as the center of rotation such that the workpiece is able to rotate at fast speed, and the fastening or unfastening actions can be performed swiftly. When the electric torque wrench 10 is driving by the motor 30 or manual, the electric torque wrench 10 generates a deformation due to the force exertion thereon, and the torque sensing unit 50 is able to measure the deformation on the extension arm 421 and to transmit the value detected to the human-machine interface 23 for processing, thereby displaying the corresponding torque value. When it reaches the setting torque value, the human-machine interface 23 also provides corresponding alert. Furthermore, the extension arm 421 of the ring gear member 42 and the mounting portion 62 of the driving device 60 are attached to the internal of the outer housing 20, and the two fastening pieces 424 on the circular ring 423 and the two extension arms 421 are respectively secured inside the fastening slot 621 and the retaining slot 622 respectively, such that the force exerted onto the driving device 60 can be directly transmitted to the ring gear member 42. In addition, the ring gear member 42 would not generate rotation relative to the driving device 60 due to the force exertion that may affect the detection result. The force applied to the mounting portion 62 can be directly transmitted to the extension arm 421 such that the force borne by the extension arm 421 is equivalent to the driving device 60. Furthermore, the two sides of the two extension arms 421 are formed to be of hollow shape; therefore, the overall force exertion area is reduced and the degree of freedom is increased, leading to an increase of the deformation with respect to the force exertion, thereby increasing the sensitivity of the detection. Moreover, the two extension arms 421 are arranged to form an angle θ of 90 degrees with the operating plane A, which is in the same direction as the direction of deformation, such that the torque value can be detected properly. When the workpiece is rotated to the fastened state, in this embodiment, such state refers to a torque reaching 80% of the torque setting value, and at this time, with the control of the human-machine interface 23, the action of the motor 30 is stopped or is unable to further drive the motor 30 to rotate, thereby preventing the motor 30 to generate an overly large torque that may excessively exceed the setting value.

Please refer to FIG. 7, when the motor 30 stops, the user can then use his or her hand force to manually rotate the electric torque wrench 10 in order to make it to reach the appropriate torque value. Through the human-machine interface 23 on the outer housing 20, a setting torque value can be set, and it can be equipped with the function of displaying the torque value, allowing the user to set the setting torque value through the human-machine interface 23, and display the applying torque value. When the user uses his or her hand to manually rotate the electric torque wrench 10, the axial direction C of the working head 61 can be used as a supporting point such that the hand can hold the grip portion of the outer housing 20 to exert force. During the process of force exertion, the force exerted by the hand can cause deformation of the electric torque wrench 10, and the torque sensing units 50 can measure the deformation on the extension arm 421 and the detected value can be transmitted to the human-machine interface 23 for processing, in order to display the corresponding torque value. When it reaches the setting torque value, the human-machine interface 23 is able to provide a notice informing that the torque value reaches or about to reach the setting value. In addition, since the force exerted by the hand can be adjusted incrementally by the user, a relatively precise torque value can be applied to the working head 61. In addition, the two extension arms 421 are arranged to form an angle of 90 degrees with the operating plane A, which is in the same direction as the direction of force exertion by hand, such that the torque value can be detected properly.

Figure 9:
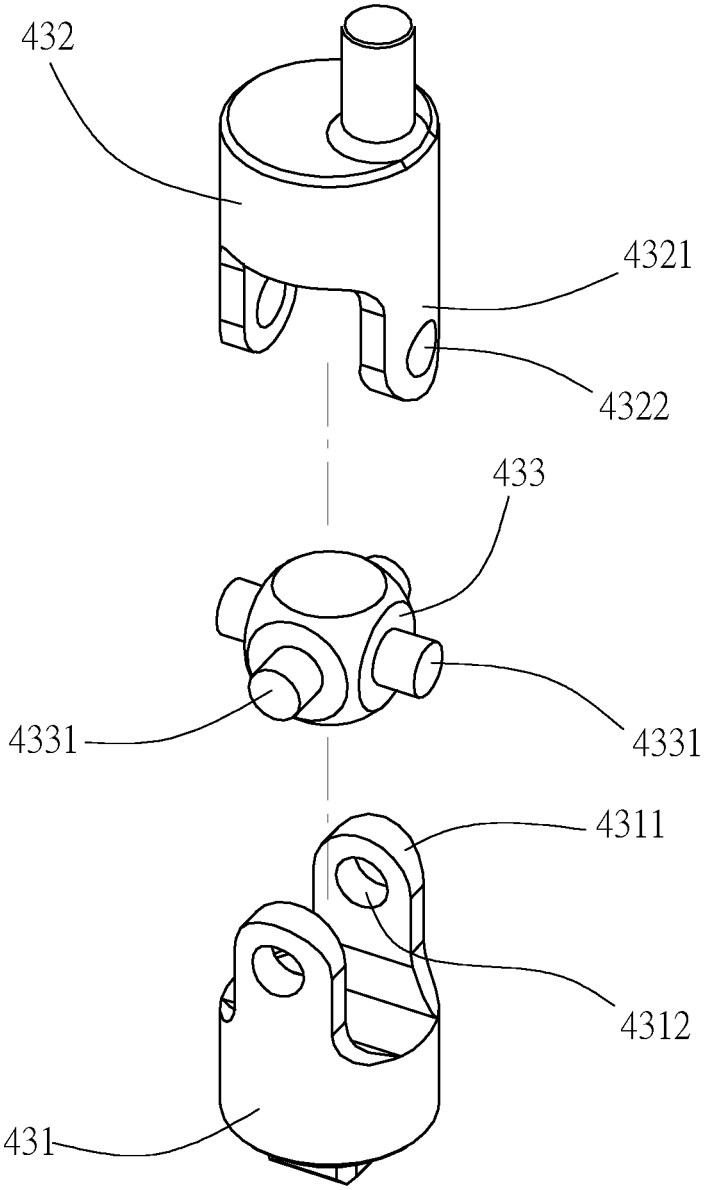
FIG. 9 is a perspective exploded view of the transmission shaft according to a second preferred embodiment of the present invention.
Figure 10:
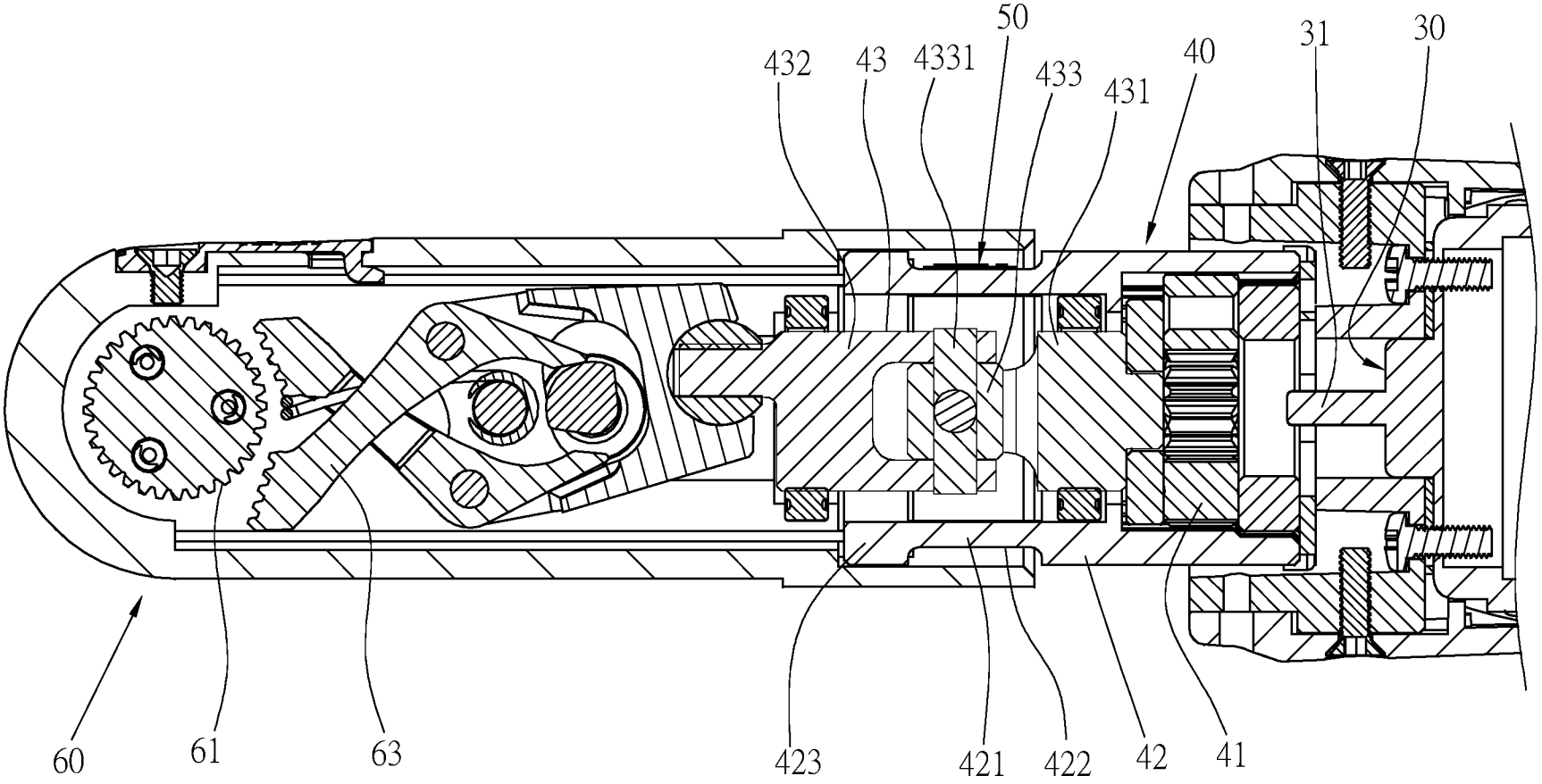
FIG. 10 is a cross sectional view in a vertical direction of the second preferred embodiment of the present invention.

Please refer to FIG. 9 and FIG. 10, showing a second preferred embodiment of the present invention. The main structure of the second preferred embodiment is identical to that of the first embodiment, and the same elements are denoted in the same reference numbers; therefore, details of the same elements are omitted hereafter.

The reduction gear assembly 41 of the reduction device 40 includes a transmission shaft 43 formed by a first shaft 431 and a second shaft 432. One end of the first shaft 431 is engaged with the reduction gear assembly 41 and another end thereof is formed of a first seat 4311. The first seat 4311 is generally in a U shape, and its two rear ends are formed of a through hole 4312 penetrating therethrough respectively. One end of the second shaft 432 is connected to the driving device 60 and another end thereof is formed of a second seat 4321 correspondingly. The second seat 4321 is generally of a U shape, and its two rear ends are formed a through hole 4322 penetrating therethrough respectively. A universal joint 433 is arranged between the first seat 4311 of the first shaft 431 and the second seat 4321 of the second shaft 432. The circumferential surface of the universal joint 433 includes four protrusions 4331 formed thereon and arranged spaced apart from each other. The first shaft 431 and the second shaft 432 are connected to the protrusions 4331 of the universal joint 433 via the first seat 4311 and the second seat 4321 respectively, thereby allowing the first shaft 431 and the second shaft 432 to rotate synchronously with each other and transmitting the driving force of the motor 30 to the driving device 60. When manual force exertion is to be performed on the electric torque wrench 10, the first seat 4311 of the first shaft 431 and the second seat 4321 of the second shaft 432 of the transmission shaft 43 are able to generate bending with the universal joint 433 as the axis and along the direction of the force exertion, in order to prevent the transmission shaft 43 from dispersing the force exerted, thereby increasing the detection accuracy of the torque sensing unit 50.

The electric torque wrench provided by the present invention is able to perform fastening and unfastening actions at fast speed via the driving of the motor, and the torque sensing unit can be used to measure the torque value during the manual operation. For a known electric torque wrench, when a motor is used for fastening, it is likely to exceed the setting torque value. In the present invention, the electric torque wrench is able to stop the rotation when the motor reaches the setting torque value, following which the user can apply force with his or her hand to perform manual fastening, and the torque sensing unit can be used to measure and display the actual torque value, thereby achieving the precise torque value setting. Furthermore, the torque sensing unit 50 is installed on the ring gear member, and its structure is relatively the same as the original structure known; therefore, it does not require complicated processing during the manufacturing thereof. In addition, when the baking and adhesive attachment process is performed on the torque sensing unit, since most of the component parts inside the reduction device have previously received heat treatment, the baking temperature would not cause deformation on such component arts. As a result, the original precision of the component parts can be maintained, and the assembly yield rate can be increased.

It is to be understood that the above description is only preferred embodiments of the present invention and is not used to limit the present invention, and changes in accordance with the concepts of the present invention may be made without departing from the spirit of the present invention, for example, the equivalent effects produced by various transformations, variations, modifications and applications made to the configurations or arrangements shall still fall within the scope covered by the appended claims of the present invention.

What is claimed is:

1. An electric torque wrench capable of sensing a manual operating torque, comprising:

an outer housing having an accommodating space at an internal thereof and a front end with an opening;

a motor having a driving shaft arranged inside the accommodating space of the outer housing;

a reduction device arranged inside the accommodating space of the outer housing and positioned at a front end of the motor; the reduction device having a reduction gear assembly connected to the driving shaft; the reduction gear assembly having a front end with a transmission shaft arranged thereon; the reduction gear assembly having an outer circumferential surface with a hollow ring gear member arranged thereon;

the ring gear member having a front end with at least one extension arm arranged thereon, and the extension arm having at least one sensing plane formed thereon; the transmission shaft configured to extend outward from the ring gear member;

at least one torque sensing unit arranged on the sensing plane of the at least one extension arm;

a driving device installed at the front end of the outer housing and configured to be driven by the transmission shaft; the front end having a working head, and the working head configured to be driven by the transmission shaft to generate a rotation with an axial direction of the working head as a center of rotation; the front end of the ring gear member secured and attached onto the driving device.

2. The electric torque wrench as claimed in claim 1, further comprising an operating plane arranged perpendicular to the axial direction of the working head, and a non-zero degree angle is formed between the sensing plane on the extension arm of the ring gear member and the operating plane.

3. The electric torque wrench as claimed in claim 2, wherein the angle between the operating plane of the working head and the sensing plane of the ring gear member is 1 degree°~90 degrees.

4. The electric torque wrench as claimed in claim 1, wherein front end of the ring gear member includes an extension arm.

5. The electric torque wrench as claimed in claim 1, wherein the front end of the ring gear member includes two extension arms, and the two extension arms are positioned at two sides of the front end of the ring gear member respectively.

6. The electric torque wrench as claimed in claim 1, wherein a free end of the extension arm includes a circular ring installed thereon, and the circular ring is secured and attached onto the driving device.

7. The electric torque wrench as claimed in claim 6, wherein an outer side of the ring gear member includes at least one fastening piece.

8. The electric torque wrench as claimed in claim 7, wherein the driving device includes a fastening slot and a retaining slot; the fastening piece of the ring gear member is secured inside the fastening slot, and the extension arm is positioned inside the retaining slot.

9. The electric torque wrench as claimed in claim 2, wherein a free end of the extension arm includes a circular ring installed thereon, and the circular ring is secured and attached onto the driving device.

10. The electric torque wrench as claimed in claim 9, wherein an outer side of the ring gear member includes at least one fastening piece.

11. The electric torque wrench as claimed in claim 10, wherein the driving device includes a fastening slot and a retaining slot; the fastening piece of the ring gear member is secured inside the fastening slot, and the extension arm is positioned inside the retaining slot.

12. The electric torque wrench as claimed in claim 3, wherein a free end of the extension arm includes a circular ring installed thereon, and the circular ring is secured and attached onto the driving device.

13. The electric torque wrench as claimed in claim 12, wherein an outer side of the ring gear member includes at least one fastening piece.

14. The electric torque wrench as claimed in claim 13, wherein the driving device includes a fastening slot and a retaining slot; the fastening piece of the ring gear member is secured inside the fastening slot, and the extension arm is positioned inside the retaining slot.

15. The electric torque wrench as claimed in claim 4, wherein a free end of the extension arm includes a circular ring installed thereon, and the circular ring is secured and attached onto the driving device.

16. The electric torque wrench as claimed in claim 5, wherein a free end of the extension arm includes a circular ring installed thereon, and the circular ring is secured and attached onto the driving device.

17. The electric torque wrench as claimed in claim 1, wherein a rear end of the driving device includes a hollow mounting portion; the mounting portion is installed between the outer housing and the ring gear member.

18. The electric torque wrench as claimed in claim 1, wherein the torque sensing unit is a strain gauge.

19. The electric torque wrench as claimed in claim 1, wherein the torque sensing unit is electrically connected to a human-machine interface.

20. The electric torque wrench as claimed in claim 1, wherein the transmission shaft of the reduction device is formed by a first shaft and a second shaft; the first shaft is engaged with the reduction gear assembly, and the second shaft is connected to the driving device; a universal joint is arranged between the first shaft and the second shaft.

* * * * *